US008427382B2

(12) United States Patent
Crouch

(10) Patent No.: US 8,427,382 B2
(45) Date of Patent: Apr. 23, 2013

(54) POWER COMBINER/DIVIDER FOR COUPLING N-COAXIAL INPUT/OUTPUTS TO A WAVEGUIDE VIA A MATCHING PLATE TO PROVIDE MINIMIZED REFLECTION

(75) Inventor: David Crouch, Corona, CA (US)

(73) Assignee: Raytheon Company, Waltham, MA (US)

( * ) Notice: Subject to any disclaimer, the term of this patent is extended or adjusted under 35 U.S.C. 154(b) by 347 days.

(21) Appl. No.: 12/846,785

(22) Filed: Jul. 29, 2010

(65) Prior Publication Data

US 2012/0025928 A1 Feb. 2, 2012

(51) Int. Cl.

| | |
|---|---|
| ***H01Q 15/24*** | (2006.01) |
| ***H01P 1/165*** | (2006.01) |
| ***H01P 5/12*** | (2006.01) |

(52) U.S. Cl.
USPC ..... 343/756; 333/21 A; 333/125; 333/127; 333/26

(58) Field of Classification Search ..... 333/125, 333/127, 137, 24 R, 21 A, 26
See application file for complete search history.

(56) References Cited

U.S. PATENT DOCUMENTS

| | | | | |
|---|---|---|---|---|
| 2,822,525 | A | 2/1958 | Casabona | |
| 4,035,746 | A * | 7/1977 | Covington, Jr. | 333/127 |
| 5,001,444 | A * | 3/1991 | Salvan et al. | 333/135 |
| 5,010,348 | A * | 4/1991 | Rene et al. | 343/700 MS |
| 5,142,253 | A | 8/1992 | Mallavarpu | |
| 5,812,089 | A | 9/1998 | Locke | |
| 5,920,240 | A | 7/1999 | Alexanian | |
| 6,344,777 | B1 | 2/2002 | Ingram | |
| 2004/0004522 | A1 | 1/2004 | Sweeney | |
| 2010/0033272 | A1 * | 2/2010 | O'Connell et al. | 333/21 R |

FOREIGN PATENT DOCUMENTS

DE 2339775 A1 2/1975

OTHER PUBLICATIONS

Pollak et al., "Compact Waveguide-Based Power Divider Feeding Independently Any Number of Coaxial Lines," IEEE Transactions on Microwave Theory and Techniques, vol. 55, No. 5, May 2007.
D.L. Ingram "Compact W-Band Solid-State MMIC High Power Sources" 2000 IEEE MTT-S Digest.
Kenneth J. Russell "Microwave Power Combining Techniques" IEEE Transaction on Microwave Theory and Techniques, vol. MTT-27, No. 5, May 1979.
Kai Chang "Millimeter-Wave Power-Combining Techniques" IEEE Transactions on Microwave Theory and Techniques, vol. MTT-31, No. 2, Feb. 1983.
Dirk I. L. de Villiers "Design of a Ten-Way Conical Transmission Line Power Combiner" IEEE Transactions on Microwave Theory and Techniques, vol. 55, No. 2, Feb. 2007.

* cited by examiner

*Primary Examiner* — Benny Lee
(74) *Attorney, Agent, or Firm* — Eric A. Gifford

(57) ABSTRACT

To transport electromagnetic energy at high power levels, a coaxial-to-waveguide power combiner/divider comprises a length of single-conductor closed waveguide terminated at one end by a conductive end plate. A plurality N of holes is formed in the end plate. A conductive matching plate is positioned within the waveguide opposite and spaced apart from the conductive end plate and spaced apart from the inner walls of the waveguide. A plurality of coaxial input/output ports each comprise an outer conductor that is electrically and mechanically terminated at the end plate about one hole and an inner conductor that extends through the associated hole into the waveguide and is electrically and mechanically terminated at the underside of the matching plate. The location and geometry of the matching plate and physical arrangement of the N ports are chosen so that the sum of the direct reflection and the N−1 coupled reflection contributions are small.

19 Claims, 11 Drawing Sheets

POWER COMBINER/DIVIDER FOR COUPLING N-COAXIAL INPUT/OUTPUTS TO A WAVEGUIDE VIA A MATCHING PLATE TO PROVIDE MINIMIZED REFLECTION

BACKGROUND OF THE INVENTION

1. Field of the Invention

This invention relates to power combiners and power dividers. More specifically, this invention relates to power combiners/dividers having multiple coaxial ports and a single waveguide port for use at RF, microwave, and millimeter-wave frequencies.

2. Description of the Related Art

Power combiners and dividers have long been key elements in RF, microwave and millimeter-wave systems. There are numerous examples of waveguide power combiners/dividers having single-conductor waveguide inputs and output. Perhaps the best known example is the binary waveguide power divider of the type used to feed planar array antennas. As such networks are constructed from numerous Y or T waveguide junctions, they tend to be bulky, especially at lower frequencies, and cannot accommodate arbitrary numbers of outputs.

Power combiners having dual-conductor coaxial inputs and output are also known in the art. Such combiners are unsuitable for high-power applications in which the outputs of a large number of low-to-medium power sources are to be combined to obtain a single high-power output. At sufficiently high power levels, a coaxial transmission line becomes an unsuitable medium over which to transport electromagnetic energy. In such situations, a waveguide output is required.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a coaxial-to-waveguide power combiner/divider having multiple coaxial ports and a single waveguide port. Such a device is particularly well suited for transporting electromagnetic energy at high power levels.

In an embodiment, a coaxial-to-waveguide power combiner/divider comprises a length of a single-conductor closed waveguide terminated at one end by a conductive end plate. A plurality N of holes is formed in the end plate. A conductive matching plate is positioned within the waveguide opposite and spaced apart from the conductive end plate and spaced apart from the inner walls of the waveguide. A plurality of coaxial input/output ports each comprising an outer conductor that is electrically and mechanically terminated at the end plate about one hole and an inner conductor that extends through the associated hole into the waveguide and is electrically and mechanically terminated at the underside of the matching plate. The matching plate may comprise one or more segments. A support post may be attached to the underside of the matching plate to provide additional support. A second mounting plate may be mounted in a spaced apart relation to the first mounting plate to increase the operational bandwidth. When used as a combiner, the matching plate transforms the electromagnetic fields emerging from the each of the N coaxial inputs into a form that propagates in the waveguide and achieves this transformation while limiting the power reflected back towards the N sources whose outputs are combined. When used as a divider, the matching plate transforms the electromagnetic field propagating in the waveguide into a form that propagates in each of the output ports and achieves this transformation while limiting the power reflected back towards the source. The location and geometry of the matching plate and physical arrangement of the N ports are chosen so that the sum of the direct reflection and the N−1 coupled reflection contributions are small.

In an embodiment, the coaxial-to-waveguide power combiner/divider is configured so that all N input/output ports are "equivalent"; the geometry of each port is identical as is the structure of the electromagnetic field surrounding each port. Such a device is invariant to rotations through angles that are integer multiples of 360°/N and the level of reflected power at each port is the same (within manufacturing tolerances). To achieve such equivalence, the matching plate and waveguide and hole pattern in the closed end of the waveguide must exhibit an N-fold rotational symmetry, which must not be broken when the ports are energized. For example, the waveguide and matching plate may comprise N-sided polygons. Each hole in the closed end of the waveguide in positioned at the midpoint of a side of an N-sided polygon centered on the axis of symmetry common to the waveguide and matching plate. The waveguide and matching plate need not be of the same shape as long as they possess the same degree of rotational symmetry. The waveguide and matching plate may be circular in which case the ports may be uniformly distributed around the circumference of a circle centered on the axis of symmetry common to the waveguide and the matching plate.

In another embodiment, the power combiner/divider includes a plurality of coaxial ports and a cylindrical waveguide port. The coaxial ports are located on a circle whose center lies on the axis of the cylindrical waveguide, and are distributed uniformly around the circle. The center conductor of each coaxial port extends through a circular hole in the end plate of the cylindrical waveguide and attaches to the underside of a circular matching plate. Additional mechanical support for the matching plate may be provided by a post (conductive or non-conductive) attached between the center point of the waveguide end plate and that of the matching plate. The matching plate is parallel to and spaced apart from the end plate of the waveguide and the inner walls of the waveguide and is centered on the axis of the waveguide. One or more additional matching plates can be incorporated to extend the bandwidth of the power combiner/divider. Each additional matching plate may be supported by a post extending from the center of its underside to the top of the matching plate beneath it. The positions of the feed points and the size, spacing, and number of matching plates are chosen to limit the total power reflected at each port when all ports are simultaneously energized. When used as a power combiner, the phase of each input advances by 360°/N relative to the previous input in sequence around the circle, where N is the number of coaxial input ports. The resulting wave that is launched into the waveguide may be circularly polarized. When used as a power divider, the power incident from the waveguide on the power divider is divided among the coaxial outputs. If the incident wave is circularly polarized, the power is equally divided among the N outputs. If the wave is linearly polarized, the power division is unequal.

These and other features and advantages of the invention will be apparent to those skilled in the art from the following detailed description of preferred embodiments, taken together with the accompanying drawings, in which:

DETAILED DESCRIPTION OF THE INVENTION

Figure 1A:
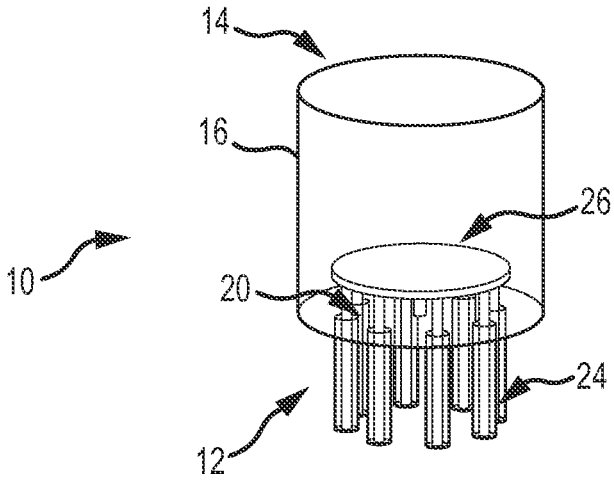
FIGS. 1*a*, 1*b*, and 1*c* are respectively perspective, side and top views of an embodiment of a coaxial-to-waveguide combiner/divider with eight coaxial ports and a single matching plate.

The present invention provides a coaxial-to-waveguide power combiner/divider having multiple (N) coaxial ports and a single waveguide port. Such a device is particularly well suited for transporting electromagnetic energy at high power levels, combined power levels that exceed the capacity of a coaxial transmission line.

In an embodiment, a coaxial-to-waveguide power combiner/divider comprises a length of single-conductor closed waveguide terminated at one end by a conductive end plate. A plurality N of holes is formed in the end plate. A conductive matching plate is positioned within the waveguide opposite and spaced apart from the conductive end plate and spaced apart from the inner walls of the waveguide. A plurality of dual-conductor coaxial input/output ports each comprising an outer conductor that is electrically and mechanically terminated at the end plate about one hole and an inner conductor that extends through the associated hole into the waveguide and is electrically and mechanically terminated at the underside of the matching plate. The matching plate may be a single piece or segmented. A support post may be attached to the underside of the matching plate to provide additional support. A second mounting plate may be mounted in a spaced apart relation to the first mounting plate to increase the operational bandwidth. When used as a combiner, the matching plate transforms the electromagnetic fields emerging from the each of the N coaxial inputs into a form that propagates in the waveguide and achieves this transformation while limiting the power reflected back towards the N sources whose outputs are combined. When used as a divider, the matching plate transforms the electromagnetic field propagating in the waveguide into a form that propagates in each of the output ports and achieves this transformation while limiting the power reflected back towards the source. The location and geometry of the matching plate and physical arrangement of the N ports are chosen so that the sum of the direct reflection and the N−1 coupled reflection contributions are small.

The matching plate utilized in an N-way power combiner serves two purposes. Its first purpose is to transform the electromagnetic fields emerging from each of N coaxial input ports into a form that can propagate in the output waveguide and can be easily utilized at the output of the power combiner. For example, in an N-way power combiner realized in a cylindrical waveguide, the matching plate transforms the fields delivered by the N coaxial input ports into the circularly polarized $TE_{11}$ guided-wave mode, the preferred mode for use in cylindrical waveguide.

The second purpose of the matching plate is to achieve the first purpose while reflecting minimal power back towards the N sources whose outputs are to be combined. Two mechanisms contribute to the power reflected at each port of the power combiner. The first mechanism is a direct reflection in which a portion of the power incident on a given port is reflected by the same port towards its source. The second mechanisms results from coupling of all other ports to the port in question; that is, in an N-way combiner a portion of the power delivered by each port to the combiner leaks out of each of the N−1 other input ports. While it may be possible to nearly eliminate the directly reflected component of the reflected power, it is not possible to simultaneously eliminate all the coupled components. Fortunately, it is not necessary. The location and geometry of the matching plate and the physical arrangement of the N input ports are chosen so that at each input port the sum of the direct reflection and the N−1 coupled contributions is small.

Since power combiners are often used to combine the outputs of multiple radio-frequency (RF) sources having identical construction, it is generally desirable that such a combiner be capable of accepting the same power at each input port with minimal reflection. Power combiners lacking this capability will reflect a portion of the excess power unless the power incident on the over-driven input ports is reduced. The power incident on an over-driven input port is reduced either by attenuating the output of the corresponding RF source, or by modifying the electrical inputs to the RF source in such a way as to reduce its RF output power. For example, if the source is a transistor-based solid-state amplifier, the DC bias levels may be modified to reduce the RF output power, or the RF power level of the input signal may be reduced. In either case, the result is a loss in efficiency and a total combined output power that is less than the capacity of the RF sources. On the other hand, an N-way power combiner whose input ports are equivalent can accept the same input power at each port, allowing each source to operate at full power and resulting in a combined power output that matches the capacity of the RF sources.

The coaxial-to-waveguide power combiner/divider may utilize a geometry in which each port is geometrically equivalent to all other ports. That is, an N-way power combiner possesses N-fold rotational symmetry, so that it is invariant to rotations of 360°/N about its axis of symmetry (i.e., the center axis of the output waveguide). Furthermore, this symmetry must not be broken when the ports are energized; the power combiner must retain its N-fold rotational symmetry while all input ports are energized.

An energized N-way power combiner meeting the symmetry requirements set forth in the previous paragraph is invariant to rotations through angles that are integer multiples of 360°/N. As a result, all N input ports are equivalent; the geometry of each port is identical, as is the structure of the electromagnetic field surrounding each port. A further result is that the level of reflected power at each port will be the same within limits imposed by finite manufacturing tolerances. This feature greatly simplifies the design process, as any geometric changes that maintain N-fold rotational symmetry have the same effect on the electrical performance at all input ports. Therefore, if one input port is matched sufficiently well that the reflected power level is at or below the design requirement; the same will be true for all input ports.

In a power combiner/divider the device utilizes a circular waveguide and a circular matching plate. When the input ports are uniformly distributed around the circumference of a circle centered on the axis of symmetry common to the waveguide and the matching plate, the degree of symmetry is equal to the number of input ports, i.e., an N-way combiner will have N-fold rotational symmetry. It is not necessary that the waveguide and matching plate be circular to attain the same degree of symmetry. It is only necessary that the waveguide and the matching plate each possess N-fold rotational symmetry. For example, one can construct a 4-way power combiner using a square waveguide and a square matching plate. The waveguide and the matching plate need not be of the same shape; all that is necessary is that they possess the same degree of rotational symmetry. For example, a regular octagonal matching plate may replace the square matching plate. The principal can be extended to any N-sided polygon with the proper symmetry.

Figure 1B:
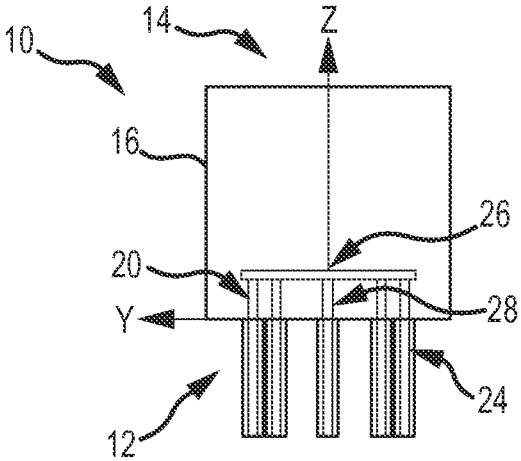
Figure 1C:
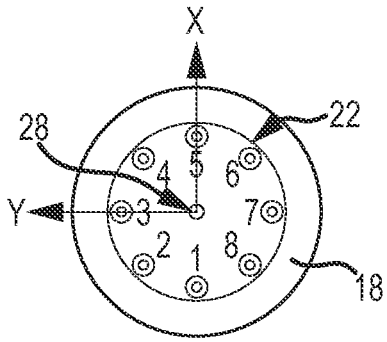

As shown in FIGS. 1*a* through 1*c*, an embodiment of a coaxial-to-waveguide power combiner/divider 10 (FIGS. 1*a* & 1*b*) transforms electromagnetic energy between N coaxial ports 12 (FIGS. 1*a* & 1*b*)and a single cylindrical waveguide port 14 (FIGS. 1*a* & 1*b*). The combiner/divider comprises a length of cylindrical waveguide 16 (FIGS. 1*a* & 1*b*) terminated at one end by a conductive end plate 18 (FIG. 1*c*) that lies in a plane defined by the X and Y-axes. The inner center conductors 20 (FIGS. 1*a* & 1*b*) of N coaxial input lines extend through circular holes 22 (FIG. 1*c*) cut into this wall. In the illustrative eight-port (N=8) embodiment shown in FIGS. 1*a*-1*c*, the diameter of each hole is equal to the inside diameter of the outer conductor 24 (FIGS. 1*a* & 1*b*) of the corresponding coaxial transmission line. The outer conductor 24 (FIGS. 1*a* & 1*b*) of each coaxial transmission line is electrically and mechanically terminated (good electrical and mechanical contact) at the end plate 18 (FIG. 1*c*) about one hole 22 (FIG. 1*c*). The inner conductor 20 (FIGS. 1*a* & 1*b*)of each coaxial transmission line extends through the corresponding hole and into the waveguide and is electrically and mechanically terminated (good electrical and mechanical contact) at the underside of a circular matching plate 26 (FIGS. 1*a* & 1*b*). The circular matching plate 26 (FIGS. 1*a* & 1*b*)is parallel to and spaced apart from the waveguide's conductive end plate 18 (FIG. 1*c*) and inner walls, and the axis of the plate is coincident with the axis of the waveguide along the Z-axis (FIG. 1*b*). Additional mechanical support for the matching plate may be provided by a post 28 (conductive or non-conductive) rigidly attached to the end plate at one end and to the circular matching plate at the other end as shown in FIGS. 1*b* & 1*c*. If the post 28 is conductive it is suitable positioned along the axis passing through the center of the end plate and matching plate to minimize and disruption of the fields. This structure possesses the rotational symmetry previously described and thus the ports are "equivalent".

When operated as a power combiner, each coaxial port is simultaneously energized by a separate source of electromagnetic energy, a solid-state power amplifier, for example. Each source must be mutually coherent; that is, all sources must generate an output signal having a common frequency and a fixed phase with respect to all other output signals. In order to deliver maximum power to the output, it is desirable to deliver the same power level to all ports. Towards this end, the ports are placed at equal angular intervals on a circle whose center coincides with that of the waveguide endplate. Under ideal conditions, the amplitudes of all excitations are equal, and the phase of each excitation progresses by 360°/N sequentially. For example, in the eight-port implementation shown in FIGS. 1*a*-1*c*, the amplitudes of the signals incident on ports 1, 2, 3, 4, 5, 6, 7, 8 (as shown in FIG. 1*c*) are equal, and their phases are [0°, 45°, 90°, 135°, 180°, 225°, 270°, 315°], respectively. Under these conditions, the wave launched into the waveguide is right-hand circularly polarized in the fundamental $TE_{11}$ cylindrical waveguide mode. Those skilled in the art will appreciate that the present invention will continue to function as intended under non-ideal conditions, i.e., when there are minor differences between amplitudes and phases and their ideal values.

The active return loss seen at each input port is a key performance discriminator, as most sources of electromagnetic energy are sensitive to excessive levels of reflected power. The active return loss at a given input port is given by:

$$\text{Active Return Loss} = -20\log_{10}\left(\frac{P_{return}}{P_{input}}\right), \tag{1}$$

where $P_{input}$ is the power incident on the input port and $P_{return}$ is the power returning from the input port under normal operating conditions. That is, for the power combiner input port $P_{return}$ is measured or calculated when all input ports are driven simultaneously. By properly choosing the dimensions of the power combiner, the total returned power at any given port is minimized. In the power combiner shown in FIGS. 1*a*-1*c* the radius of the circle on which said uniformly-distributed inner conductors attach to the underside of the matching plate and the radius of the matching plate and the spacing between the matching and end plates are configured so that at each port the sum of a direct reflection of power and the N−1 coupled reflection contributions are minimized. The power combiner shown in FIGS. 1*a*-1*c* has eight coaxial inputs; the inner and outer conductor diameters are, for example, 0.2" and 0.46", respectively, corresponding to a characteristic impedance of 50 Ohms. The center of each coaxial input is located on a circle 3.23" in diameter with an angular separation of 45° between neighboring inputs for example. The cylindrical waveguide is for example 5.28" in diameter (EIA designation WC 528). The recommended frequency range of this particular waveguide for the fundamental $TE_{11}$ mode is from 1.51 GHz to 2.07 GHz. The center conductors of each coaxial input protrude through the end plate of the cylindrical waveguide and extend upward to the underside of the metal matching plate, to which each conductor is joined. The matching plate is, for example 0.15" thick, 3.79" in diameter, and is located in the center of the circular waveguide 0.8609"

above the end plate. Additional mechanical support may be provided by a 0.25" diameter metal support post that extends from the center of the end plate to the center of the matching plate.

Figure 2:
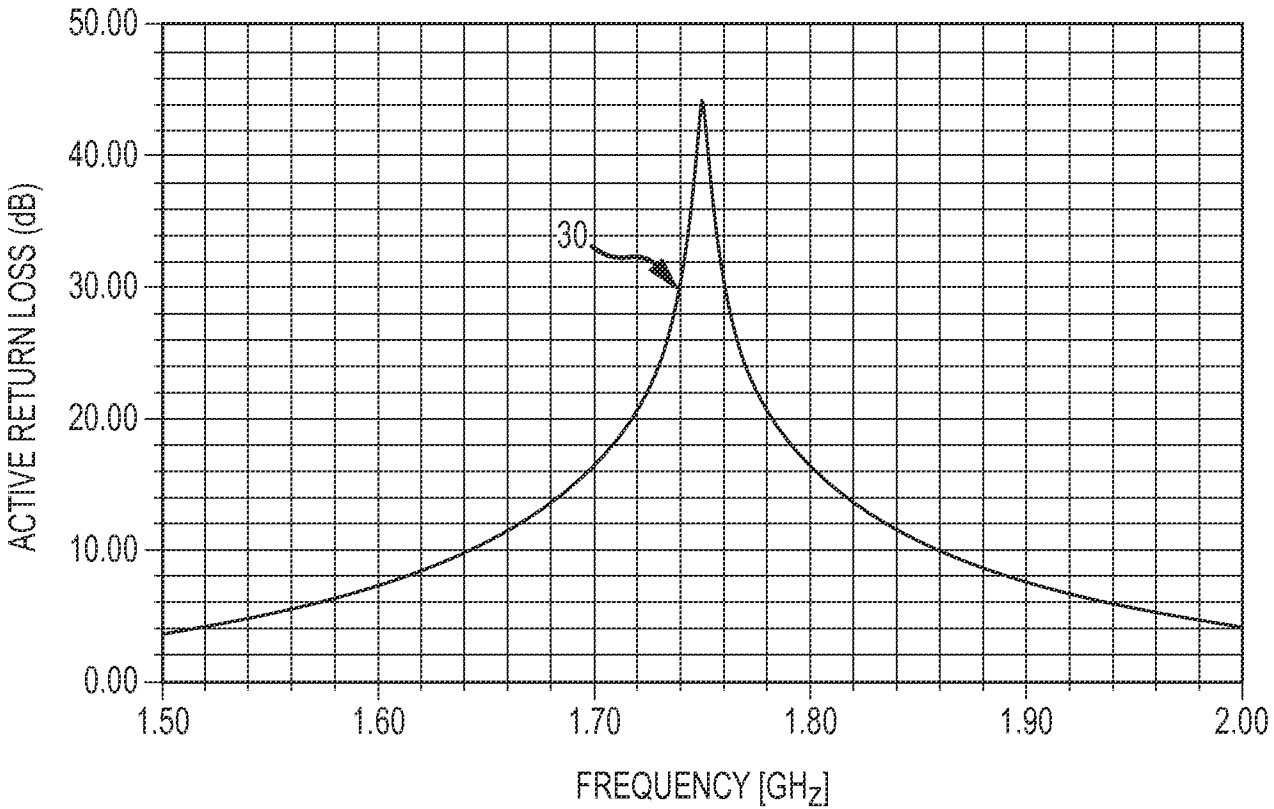
FIG. 2 is a graph of the calculated active return loss vs. frequency for each of the eight coaxial ports of the coaxial-to-waveguide power combiner/divider illustrated in FIGS. 1*a*-1*c;*

The power combiner shown in FIGS. 1*a*-1*c* is physically invariant to rotations of 360°/N about the waveguide axis. When the excitation phases progress sequentially by 360°/N, each coaxial input is physically and electrically equivalent. That is, each coaxial input sees the same physical environment and has nearest neighbors whose phases differ from its own by 360°/N to one side and by −360°/N to the other side. Therefore, if any one port is matched, all N ports are matched. FIG. 2 shows the calculated active return loss 30 in dB vs. Frequency in GHz for each port of the eight-port power combiner shown in FIGS. 1*a*-1*c*. The calculated performance for all eight ports will be identical due to the rotational symmetry of the structure and its excitations. The results shown in FIG. 2 are for a design that has been optimized to maximize the active return loss at a frequency of 1.75 GHz. In this embodiment, the chosen optimization variables are the diameter of the circle upon which the coaxial feeds are located, the distance between the end plate of the circular waveguide and the matching plate, and the diameter of the matching plate itself.

Figure 3:
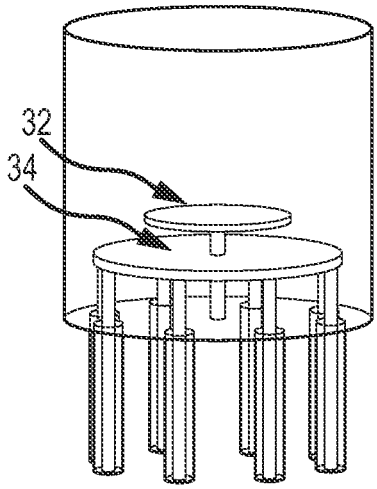
FIG. 3 is a perspective view of an embodiment of a coaxial-to-waveguide combiner/divider with eight coaxial ports and two matching plates.

The bandwidth over which the active return loss of the eight-port power combiner shown in FIGS. 1*a*-1*c* exceeds 20 dB is 66 MHz. Some applications, however, may require more bandwidth. Stacking a second matching plate 32 on top of the first, as shown in FIG. 3, can extend the bandwidth of the coaxial-to-waveguide power combiner. A support post 34 supports the second matching plate 32. An optimized power combiner has been designed by specifying that the diameter of the circle upon which the coaxial inputs are located is to be 0.2" less than that of the lower matching plate while allowing the diameters of both matching plates to vary along with the distance between the matching plates and the distance between the lower matching plate and the waveguide end plate. Like the single-matching plate design, the power combiner is executed in as WC 528 cylindrical waveguide and utilizes coaxial inputs having 0.2" diameter inner conductors and 0.46" diameter outer conductors. The diameter of the lower matching plate is 4.24" and that of the upper matching plate is 2.502", and both matching plates are 0.15" thick. The distance between the waveguide end plate and the underside of the lower matching plate is 0.9538" and the distance between the two matching plates is 0.5288". Both matching plates are supported at their centers by 0.25" diameter metal posts.

Figure 4:
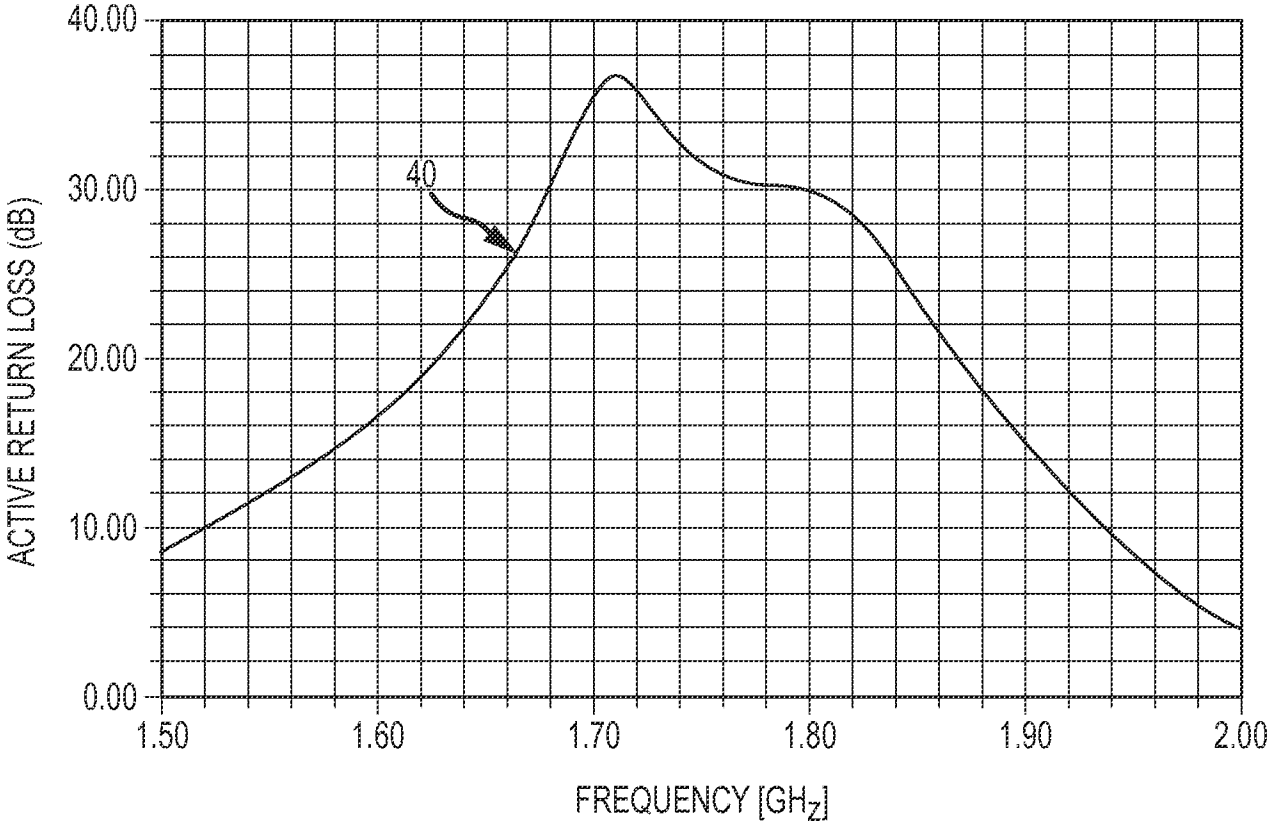
FIG. 4 is a graph of the calculated active return loss vs. frequency for each of the eight coaxial ports of the coaxial-to-waveguide power combiner/divider illustrated in FIG. 3.

The calculated performance of the power combiner is shown in FIG. 4, in which the active return loss 40 is plotted as a function of frequency. As with the single matching plate design, both the power combiner and the excitations possess eight-fold rotation symmetry, so that all eight ports are equivalent, and the calculated performance data shown in FIG. 4 is representative of all eight ports. The bandwidth over which the return loss exceeds 20 dB is now 242 MHz, which represents a fractional bandwidth of 13.8% relative to a center frequency of 1.75 GHz. If necessary, the bandwidth can be further extended by incorporating additional matching plates.

Those skilled in the art will appreciate that the number of coaxial interfaces is not limited to powers of two, or to even numbers. The only limitation on the number of coaxial interfaces is due to the need to physically accommodate them within the boundary of the waveguide end plate. This limitation can be mitigated somewhat by transitioning to smaller coaxial interfaces if the number of desired interfaces is such that mechanical interference between neighboring interfaces becomes a problem. Furthermore, it may be possible to position the ports on concentric circles. Those skilled in the art will further appreciate that the invention is not limited to any particular frequency range and can be implemented at any desired frequency by choosing its physical dimensions appropriately.

Figure 5A:
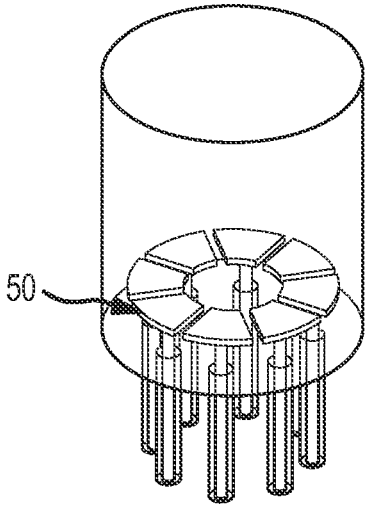
FIGS. 5*a* and 5*b* are perspective views of embodiments of a coaxial-to-waveguide combiner/divider with eight coaxial ports and a segmented first matching plate.
Figure 5B:
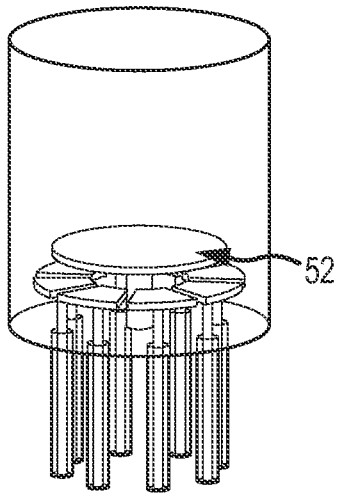

The matching plate 26 (FIGS. 1*a* & 1*b*) need not be of contiguous construction and may comprise multiple segments 50 as illustrated in FIG. 5*a*. In general, the matching plate comprises one or more segments which need not be contiguous. Furthermore, as illustrated in FIG. 5*b*, a second matching plate 52 may be added to the power combiner shown in FIG. 5*a* as a way of increasing the operating bandwidth.

Figure 6A:
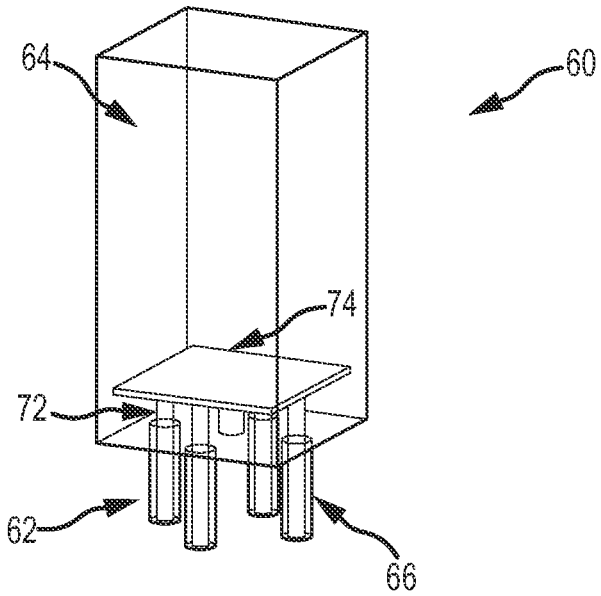
FIGS. 6*a*, 6*b* and 6*c* are perspective, side and end views of an embodiment of a coaxial-to-waveguide combiner/divider with four coaxial ports and a single matching plate.
Figure 6B:
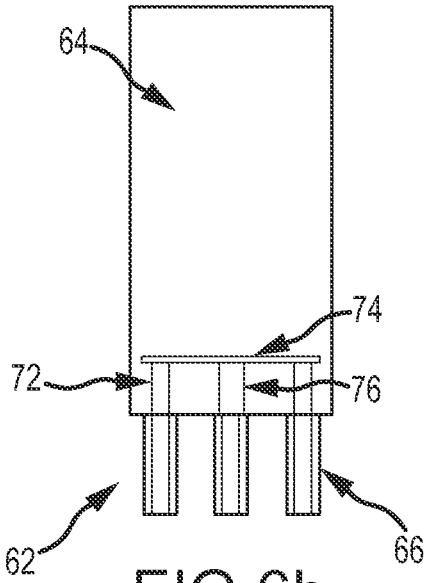
Figure 6C:
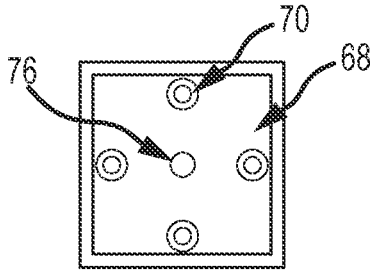

The waveguide that transports the combined power to its destination need not be circular. The waveguide and matching plate may be N-sided polygons. Furthermore the waveguide and matching plate need not have the same shape as long as they maintain the same N-fold rotational symmetry. A non-circular example is shown in FIGS. 6*a* through 6*c*, which illustrates a square four-port coaxial-to-waveguide power combiner/divider 60 (FIG. 6*a*). The power carried by four coaxial transmission lines 62 (FIGS. 6*a* & 6*b*) is combined inside a square waveguide 64 (FIGS. 6*a* & 6*b*) and then guided to its destination. The outer conductor 66 (FIGS. 6*a* & 6*b*) of each transmission line is electrically and mechanically terminated at an end plate 68 (FIG. 6*c*) about one hole 70 (FIG. 6*c*) of the square waveguide. The center conductor 72 (FIGS. 6*a* & 6*b*) of each transmission line protrudes through the hole in the end plate of the waveguide and is electrically and mechanically terminated to a square matching plate 74 (FIGS. 6*a* & 6*b*) suspended inside the square waveguide, spaced apart from the end plate and inner walls of the waveguide. Additional mechanical support may be provided by a support post 76 (FIGS. 6*b* & 6*c*) rigidly attached to the center of the end wall at one end and to the center of the square matching plate at the other end. The support post may be conductive or non-conductive.

The coaxial-to-waveguide power combiner/divider can also be used to generate a linearly polarized wave in the output waveguide at a reduced power level. Consider once again the power combiner shown in FIGS. 1*a*-1*c*. As already stated, the power combiner produces a right-hand circularly-polarized output wave in the waveguide when the coaxial inputs have the following excitations $V_{CR}$:

$$V_{CR} = \begin{bmatrix} V_1 \\ V_2 \\ V_3 \\ V_4 \\ V_5 \\ V_6 \\ V_7 \\ V_8 \end{bmatrix} = \begin{bmatrix} A\exp(j0) \\ A\exp(j45°) \\ A\exp(j90°) \\ A\exp(j135°) \\ A\exp(j180°) \\ A\exp(j225°) \\ A\exp(j270°) \\ A\exp(j315°) \end{bmatrix}, \quad (2)$$

where $V_1$=Aexp(j0) is the excitation of input port 1, $V_2$=Aexp(j45°) is the excitation of input port 2, $V_3$=Aexp(j90°) is the excitation of input port 3, $V_4$=Aexp(j135°) is the excitation of input port 4, $V_5$=Aexp(j180°) is the excitation of input port 5, $V_6$=Aexp(j225°) is the excitation of input port 6, $V_7$=Aexp(j270°) is the excitation of input port 7, $V_8$=Aexp(j315°) is the excitation of input port 8, and A is amplitude of the excitation signal.

Figure 7:
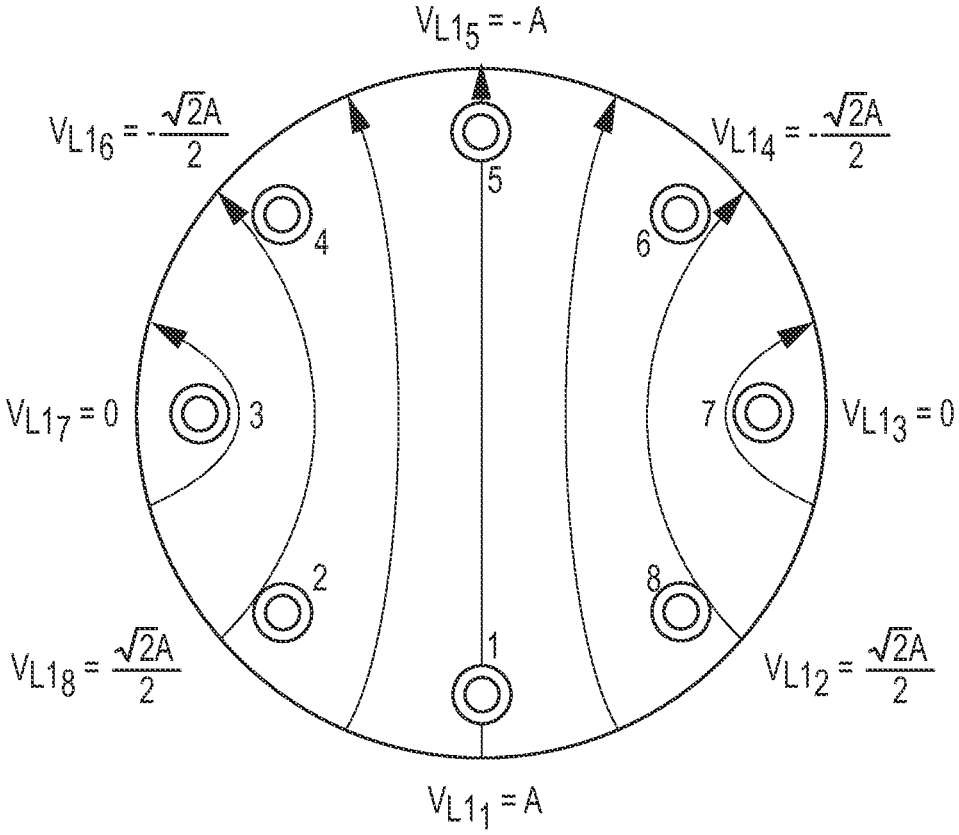
FIG. 7 is a diagram showing the electric fields lines for a linearly polarized $TE_{11}$ mode in an eight-port cylindrical waveguide and the coaxial input excitations required to excite this mode.
Figure 8A:
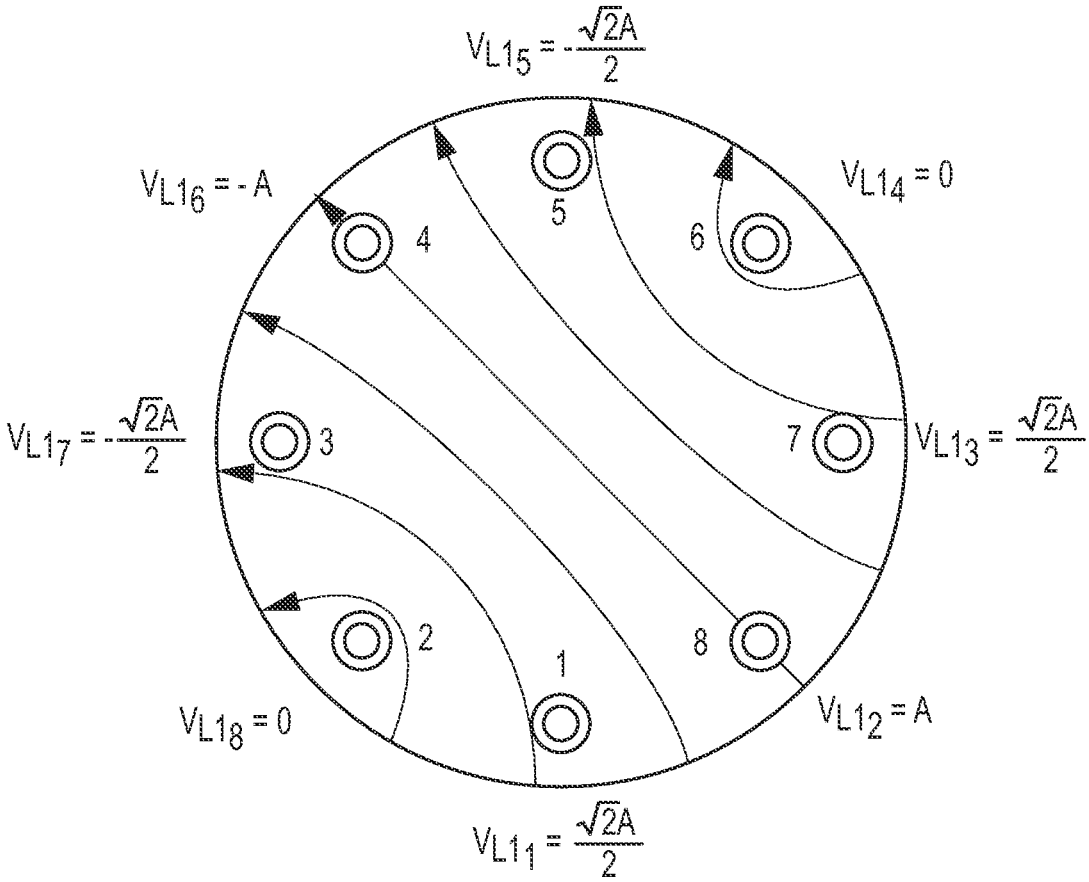
FIGS. 8*a* and 8*b* are diagrams showing the electric fields lines for $TE_{11}$ modes in cylindrical waveguide having two different linear polarizations and their corresponding coaxial input excitations.

If the phase progression is reversed with excitations $V_{CL}$, i.e., if $$V_{CL} = \begin{bmatrix} V_1 \\ V_2 \\ V_3 \\ V_4 \\ V_5 \\ V_6 \\ V_7 \\ V_8 \end{bmatrix} = \begin{bmatrix} A\exp(j0) \\ A\exp(j315°) \\ A\exp(j270°) \\ A\exp(j225°) \\ A\exp(j180°) \\ A\exp(j135°) \\ A\exp(j90°) \\ A\exp(j45°) \end{bmatrix} = \begin{bmatrix} A\exp(j0) \\ A\exp(-j45°) \\ A\exp(-j90°) \\ A\exp(j135°) \\ A\exp(-j180°) \\ A\exp(-j225°) \\ A\exp(-j270°) \\ A\exp(-j315°) \end{bmatrix}, \tag{3}$$

then the power combiner produces a left-hand circularly-polarized wave in the output waveguide. As the power combiner is a linear device, the principle of superposition can be applied. It is well known to those skilled in the art that the linear superposition of two circularly-polarized waves of opposite handedness yields a linearly polarized wave when combined in phase. Therefore if the input excitations $V_{L1}$ corresponding to circularly-polarized outputs of opposite handedness are combined, the output wave will be linearly polarized. For example, if the input excitations are given by:

$$V_{L1} = \frac{V_{CR} + V_{CL}}{2} = \tag{4}$$

$$\frac{1}{2}\begin{bmatrix} A\exp(j0) \\ A\exp(j45°) \\ A\exp(j90°) \\ A\exp(j135°) \\ A\exp(j180°) \\ A\exp(j225°) \\ A\exp(j270°) \\ A\exp(j315°) \end{bmatrix} + \frac{1}{2}\begin{bmatrix} A\exp(j0) \\ A\exp(-j45°) \\ A\exp(-j90°) \\ A\exp(j135°) \\ A\exp(-j180°) \\ A\exp(-j225°) \\ A\exp(-j270°) \\ A\exp(-j315°) \end{bmatrix} = \begin{bmatrix} A \\ \sqrt{2}A/2 \\ 0 \\ -\sqrt{2}A/2 \\ -A \\ -\sqrt{2}A/2 \\ 0 \\ \sqrt{2}A/2 \end{bmatrix},$$

then the wave launched into the circular waveguide will be vertically polarized in the $TE_{11}$ waveguide mode as shown in FIG. 7. The coaxial input excitations required to excite this mode at input ports 1,2,3,4,5,6,7 and 8 are $V_{L11}$=A, $V_{L12}$=SQRT(2)A/2, $V_{L13}$=0, $V_{L14}$=−SQRT(2)A/2, $V_{L15}$=−A, $V_{L16}$=−SQRT(2)A/2, $V_{L17}$=0 and $V_{L18}$=SQRT(2)A/2, respectively, where SQRT is the square root operator. Moreover, by rotating the excitations around the axis of the power combiner, one can rotate the polarization in 45° increments as shown in FIGS. 8*a* (45 degree linear polarization) and 8*b* (horizontal linear polarization). For example, the excitations $V_{L2}$ needed to generate a horizontally-polarized $TE_{11}$ waveguide mode are $$V_{L2} = \begin{bmatrix} 0 \\ \sqrt{2}A/2 \\ A \\ \sqrt{2}A/2 \\ 0 \\ -\sqrt{2}A/2 \\ -A \\ -\sqrt{2}A/2 \end{bmatrix}. \tag{5}$$

By applying the principle of superposition once again, one can combine the excitations $V_{L1}$ and $V_{L2}$ to obtain a linearly polarized output wave having any desired polarization. For example, if it is desired to generate a linearly-polarized output wave in the $TE_{11}$ mode whose polarization axis makes an angle of ϕ with respect to the polarization angle ϕ=0 of $V_{L1}$, the correct excitations Vϕ are:

$$V_\phi = V_{L1}\cos\phi + V_{L2}\sin\phi = \begin{bmatrix} A\cos\phi \\ \sqrt{2}A(\cos\phi + \sin\phi)/2 \\ A\sin\phi \\ \sqrt{2}A(-\cos\phi + \sin\phi)/2 \\ -A\cos\phi \\ -\sqrt{2}A(\cos\phi + \sin\phi)/2 \\ -A\sin\phi \\ \sqrt{2}A(\cos\phi - \sin\phi/2 \end{bmatrix}. \tag{6}$$

Figure 8B:
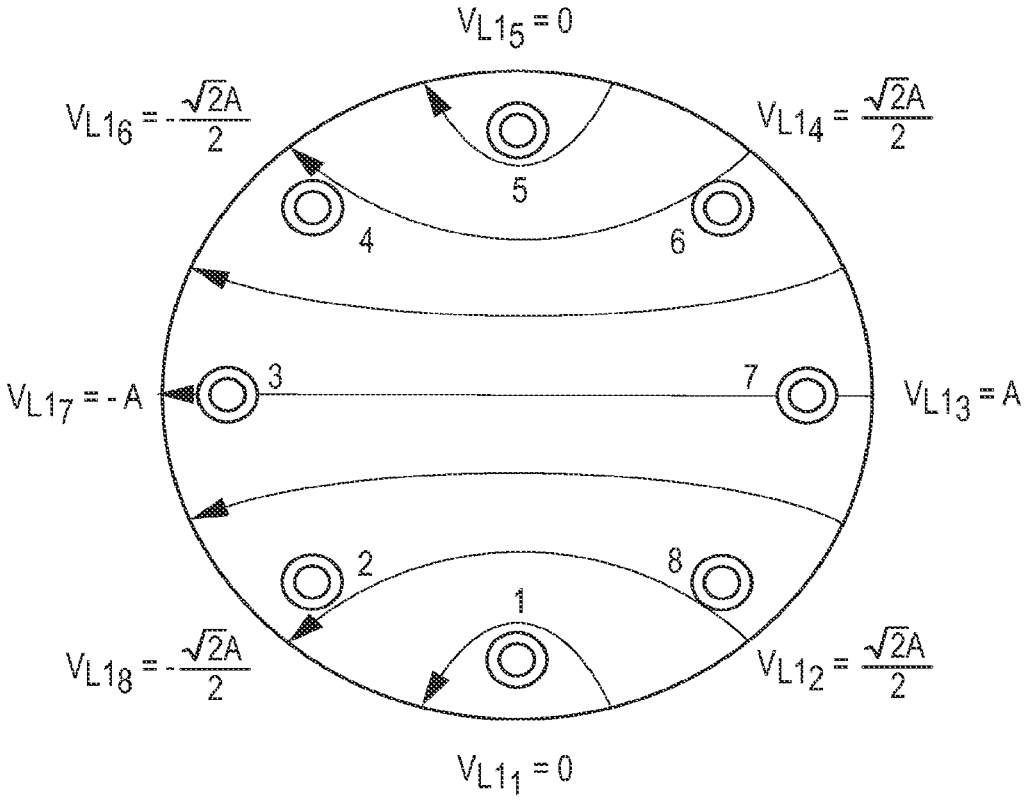

As shown in FIG. 8*a*, the coaxial input excitations required to excite the ϕ=45° mode at input ports 1,2,3,4,5,6,7 and 8 are $V_{L11}$=SQRT(2)A/2, $V_{L12=A,\ \nu L13}$=SQRT(2)A/2, $V_{L14}$=0, $V_{L15}$=−SQRT(2)A/2, $V_{L16}$=−A, $V_{L17}$=−SQRT(2)A/2 and $V_{L18}$=0, respectively. As shown in FIG. 8*b*, the coaxial input excitations required to excite the ϕ=90° mode at input ports 1,2,3,4,5,6,7 and 8 are $V_{L11}$=0, $V_{L12}$=SQRT(2)A/2, $V_{L13}$=A, $V_{L14}$=SQRT(2)A/2, $V_{L15}$=0, $V_{L16}$=−SQRT(2)A/2, $V_{L17}$=−A and $V_{L18}$=−SQRT(2)A/2, respectively.

Finally, superposition can also be used to realize any desired elliptically polarized output by combining the appropriate circularly- and linearly-polarized input excitations.

If a user of this invention has control over only the phases of the inputs, the invention can generate either a right-hand or a left-hand circularly polarized $TE_{11}$ output in cylindrical waveguide when all inputs have nearly equal amplitudes. If a user has control over both phase and amplitude, the invention can generate a $TE_{11}$ output in cylindrical waveguide having any arbitrary circular or linear polarization.

These features are general and are not limited to power combiners with eight inputs. The ability to generate circularly- and linearly-polarized outputs also applies to power combiners having arbitrary numbers of coaxial input ports. For example, if N=16, the required excitations for linear polarization are obtained from the excitations for right- and left-hand circular polarization via superposition in exactly the same way as for N=8. By rotating the excitations around the axis of the power combiner in a manner analogous to that shown in FIGS. 7 and 8*a* and 8*b* for N=8, the polarization can be rotated in increments of 360°/N=22.5°; in particular, by rotating the excitations by 4×22.5°=90°, the output polarization is rotated by 90°. As with the eight-port power combiner, the excitations for the two orthogonally-polarized linear outputs can be superposed to yield the set of excitations needed to generate any desired linear polarization.

When the power combiner/divider is used to generate a linearly polarized output, the excitations are not uniform in amplitude as they are when a circularly polarized output is desired. If it is assumed that the maximum excitation amplitude A is the same for both circularly- and linearly-polarized outputs, then the input power is proportional to $8A^2$ when the output is circularly polarized, and $4A^2$ when the output is linearly polarized. That is, in the case of an eight-way power combiner, the linearly-polarized output power is one-half that of the circularly-polarized output power. This result is general and holds for an N-way power combiner.

Figure 9A:
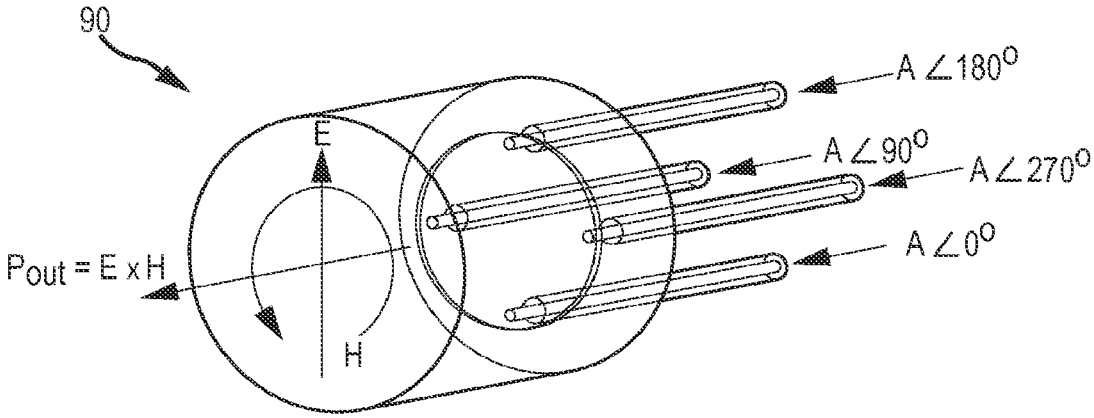
FIGS. 9*a* and 9*b* are respectively a diagram of a four-port coaxial-to-waveguide power combiner and the corresponding port input excitations for a right-hand circularly-polarized output and a diagram of a four-port coaxial-to-waveguide power divider with a right-hand circularly polarized input and the corresponding port output excitations.
Figure 9B:
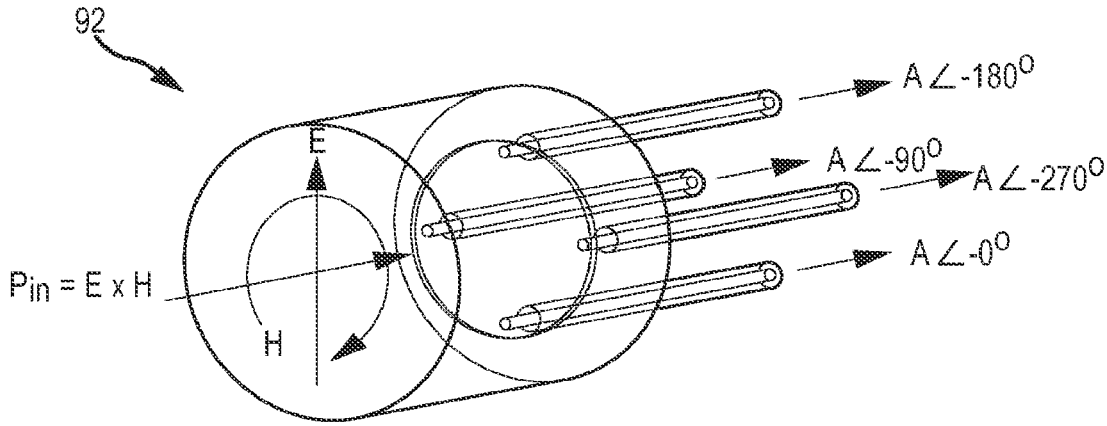

The described device is a power divider as well as a power combiner. One way to see that this is true is to apply the principle of time-reversal invariance. In a region devoid of losses, Maxwell's equations are time-reversal invariant. That is, a particular solution to Maxwell's equations is also a solution when the direction of time is reversed, i.e., run backwards. When applied to the present device, the principle of time-reversal invariance reveals the following: When a solution to Maxwell's equations for a power-combiner implementation of the invention is time reversed, a circularly-polarized $TE_{11}$-mode wave impinges on the device from the waveguide and generates time-reversed versions of the original power-combiner excitations at the coaxial interfaces. Due to time reversal, the power at each coaxial interface flows away from rather than into the device. In this mode of operation, power incident on the device from the waveguide is equally divided among the N coaxial output ports with a set of phases that are the conjugates of those used to generate the circularly polarized waveguide output when the device is used as a power combiner. More specifically, if a right-hand circularly polarized wave in the $TE_{11}$ mode is incident on the device, than the phases of the output signals at the N coaxial output ports will be the conjugates of those used to generate a right-hand circularly polarized. $TE_{11}$ mode output in the cylindrical waveguide. An analogous statement holds true for left-hand circularly-polarized waves. Both the power-combiner 90 and power-divider 92 modes of operation are illustrated in FIGS. 9*a* and 9*b* for a four-port implementation. As shown in FIG. 9*a*, the coaxial input excitations of the four ports are A∠0°, A∠90° A∠180° and A∠270° where "∠" is the phase that produce a combined output signal Pout=E×H where E is the electric field vector and H is the magnetic field vector. A shown in FIG. 9*b*, the input signal Pin =E×H is divided into output signals at the four ports of A∠−0°, A∠−90° A∠−180° and A∠−270°. While the coaxial-to-waveguide power combiner/divider is not lossless, those skilled in the art will appreciate that any losses are small enough that the principle of time-reversal invariance can be applied without consequence.

The principle of time-reversal invariance can also be applied to demonstrate that an incident wave in the $TE_{11}$ mode having arbitrary linear polarization generates output signals at the N coaxial output ports that are identical in amplitude and phase to the excitations applied at the same ports when an output wave having the same linear polarization is desired. For example, when the linearly-polarized $TE_{11}$ mode output wave with polarization angle $\phi$ generated by the set of excitations given by Eq. (6) is time reversed, the output signals at the coaxial output ports due to the linearly-polarized $TE_{11}$ mode input wave are also given by Eq. (6).

Figure 10:
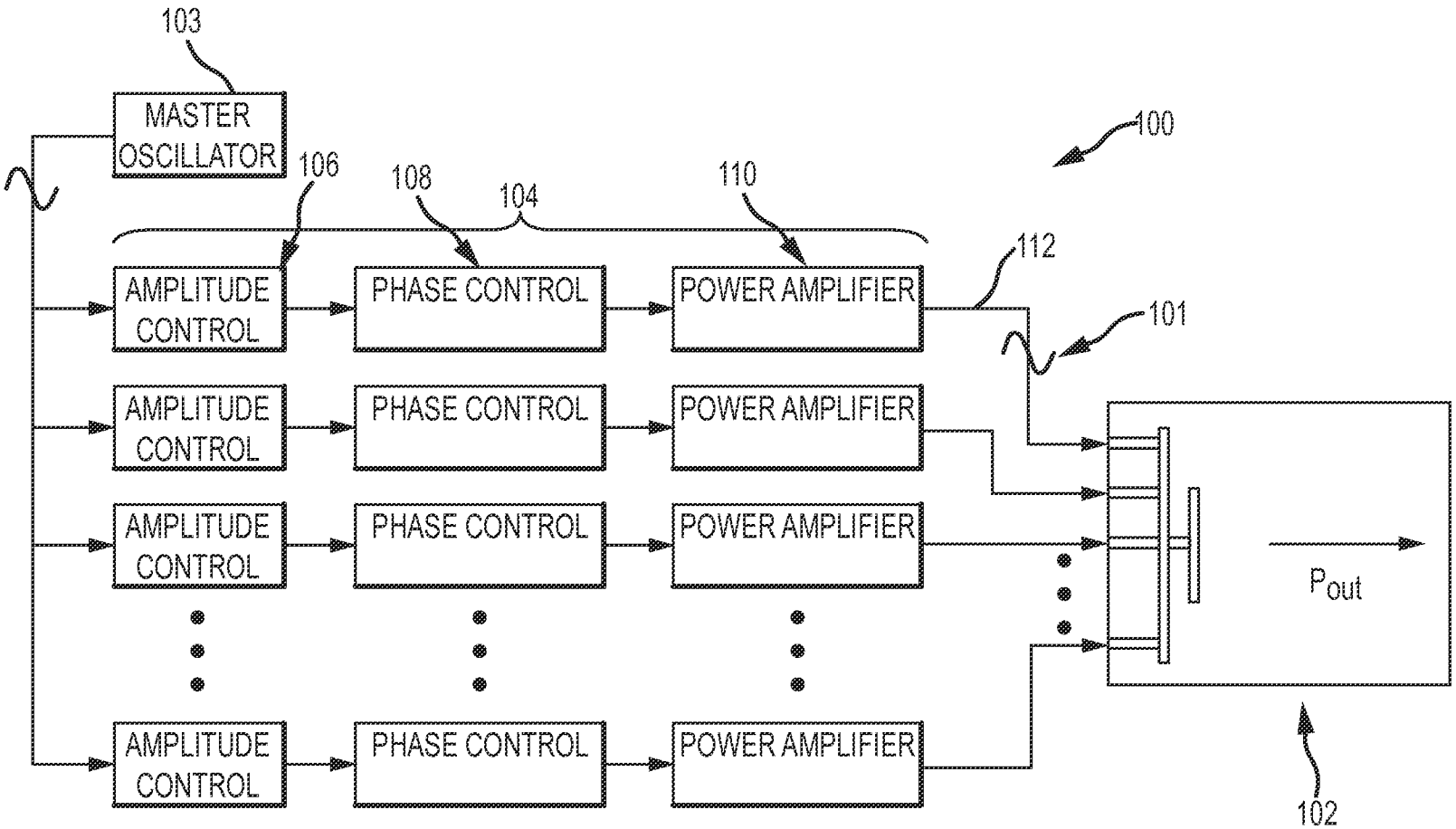
FIG. 10 is a diagram of an illustrative system for combining the outputs of numerous mutually coherent microwave sources using an N-port coaxial-to-waveguide combiner.

FIG. 10 is a diagram of an illustrative power combining system 100. When used as a power combiner, the amplitude and phase of each input signal 101 to the coaxial-to-waveguide power combiner 102 is controlled. Because the power combining method requires that each source be mutually coherent (identical frequencies and fixed phase relationships among different sources), each signal is derived from a common source, which in FIG. 10 is represented by a master oscillator 103. The power in the output signal generated by the master oscillator is equally divided N ways, and each of the N signals is used to drive a chain 104 consisting of an amplitude control unit 106, a phase control unit 108, and a power amplifier 110. Power is transported along each chain via a coaxial transmission line. The amplitude-control unit 106 may take the form of a fixed attenuator whose attenuation is chosen to approximately equalize the power at the output of each power amplifier, or it may take the form of a digitally-controlled variable attenuator. The phase-control unit 108 may be an active device such as ferrite phase shifter, a PIN diode phase shifter, or a switched-line phase shifter. if the bandwidth of operation is sufficiently narrow and the output polarization is fixed, however, the phase-control unit may be realized passively by fixed delay line, i.e., a section of transmission line whose fixed length is chosen to yield the required shift in phase. The power amplifier 110 may be a solid-state transistor-based device. The power amplifier may also be a vacuum electronic device such as a traveling-wave tube amplifier or a klystron amplifier. The N amplitude and phase-controlled signals are provided via coaxial transmission lines 112 to the input ports of power combiner 102 to output a combined signal with output power $P_{out}$.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A power combiner/divider, comprising:

a length of single-conductor closed waveguide aligned along a longitudinal axis and terminated at one end by a conductive end plate, said end plate having a plurality N of holes;

a conductive matching plate, said matching plate positioned within the waveguide opposite to and spaced apart from the conductive end plate and spaced apart from inner walls of the waveguide; and a plurality N of dual-conductor coaxial input/output ports, each port having an outer conductor that is electrically and mechanically terminated at said end plate about one said hole and an inner conductor that extends through the associated hole into the waveguide and is electrically and mechanically terminated at the underside of said matching plate, wherein the location and geometry of said conductive matching plate and the physical arrangement of the N input/output ports are configured so that at each one of the input/output ports the sum of a direct reflection of power and an N−1 coupled reflection of power are minimized.

2. The power combiner/divider of claim 1, further comprising a second conductive matching plate spaced apart from the first conductive matching plate within the waveguide.

3. The power combiner/divider of claim 1, wherein the N input/output ports are equivalent to each other.

4. The power combiner/divider of claim 3, wherein the waveguide and matching plate and physical arrangement of the N input/output ports exhibit an N-fold rotational symmetry about the axis of the waveguide.

5. The power combiner/divider of claim 4, wherein the matching plate is an N-sided polygon.

6. The power combiner/divider of claim 4, wherein the matching plate is circular and the N input/output ports are uniformly arranged on a circle having a center that lies on the axis of the waveguide.

7. The power combiner/divider of claim 1, further comprising a support post attached to the conductive end plate and the underside of the matching plate.

8. The power combiner/divider of claim 1, wherein the conductive matching plate comprises a plurality of segments.

9. The power combiner/divider of claim 8, wherein each said inner conductor is terminated to a different segment of the conductive matching plate.

10. A power combiner/divider, comprising:

a length of a single-conductor closed waveguide about an axis of the waveguide and terminated at one end by a conductive end plate, said end plate having a plurality N of holes uniformly and symmetrically arranged about and parallel to the axis of the waveguide, said waveguide exhibiting an N-fold rotational symmetry about the axis of the waveguide;

a conductive matching plate, said matching plate positioned within the waveguide opposite to and spaced apart from the conductive end plate and spaced apart from inner walls of the waveguide, said matching plate exhibiting an N-fold rotational symmetry about the axis of the waveguide; and a plurality N of equivalent dual-conductor coaxial input/output ports, each port having an outer conductor that is electrically and mechanically terminated at said end plate about an associated said hole and an inner conductor that extends through the associated hole into the waveguide and is electrically and mechanically terminated at the underside of said matching plate, wherein the location and geometry of said conductive matching plate and the physical arrangement of the N input/output ports are configured so that at each one of the input/output ports the sum of a direct reflection of power and an N−1 coupled reflection of power are minimized.

11. The power combiner/divider of claim 10, further comprising a second conductive matching plate spaced apart from the first conductive matching plate within the waveguide.

12. A system for combining and radiating electromagnetic energy, comprising:

a source or generating a plurality N of coherent signals;

N amplitude controllers, each amplitude controller adapted to receive and control the amplitude of a respective one of the N signals;

N phase controllers, each phase controller adapted to receive and control the phase of a respective one of the N signals;

N coaxial transmission lines that transport the phase controlled signals; and a power combiner/divider adapted to receive the phase controlled signals from the coaxial transmission lines and output a combined signal, comprising:

a length of single-conductor closed waveguide terminated at one end by a conductive end plate, said end plate having a plurality N of holes;

a conductive matching plate, said matching plate positioned within the waveguide opposite to and spaced apart from the conductive end plate and spaced apart from inner walls of the waveguide; and a plurality N of dual-conductor coaxial input/output ports coupled to respective ones of the coaxial transmission lines, each port having an outer conductor that is electrically and mechanically terminated at said end plate about an associated said hole and an inner conductor that extends through the associated hole into the waveguide and is electrically and mechanically terminated at the underside of said matching plate.

13. The system of claim 12, wherein the amplitude and phase controllers control the amplitudes and phases of said plurality of N coherent signals to generate an output wave having arbitrary linear polarization.

14. The system of claim 12, wherein the amplitude and phase controllers control the amplitudes and phases of said plurality of N coherent signals are chosen to generate an output wave having an arbitrary elliptical polarization.

15. A power combiner/divider, comprising:

a length of cylindrical single-conductor closed waveguide terminated at one end by a circular conductive end plate, said end plate having a plurality of circular holes of equal diameter distributed at equal angular intervals about a circle with a center that coincides with the center of the circular end plate;

a conductive circular matching plate having an axis that coincides with an axis of said cylindrical waveguide, said matching plate positioned within the waveguide opposite to and spaced apart from the conductive end plate and spaced apart from inner walls of the waveguide; and a plurality of dual-conductor coaxial input/output ports, each port having an outer conductor with an inner diameter that is equal to a diameter of the holes in said end plate and each outer conductor having an axis that coincides with an axis of the associated hole in said end plate and is electrically and mechanically attached to said end plate, and each port having an inner conductor with a center that coincides with the axis of the associated hole in the said end plate, each inner conductor extending through the associated hole and is electrically and mechanically attached to the underside of the said matching plate at a corresponding point directly above the associated hole in said end plate, wherein a radius of the circle on which said uniformly-distributed inner conductors attach to the underside of said matching plate, a radius of the matching plate and the spacing between the matching plate and the end plate are configured so that at each input/output port the sum of a direct reflection of power and an N−1 coupled reflection of power are minimized.

16. The power combiner/divider of claim 15, further comprising a second conductive matching plate spaced apart from the first conductive matching plate within the waveguide.

17. A system for combining and radiating electromagnetic energy, comprising:

a source for generating a plurality N of coherent signals;

N phase controllers, each phase controller adapted to receive and control the phase of a respective one of the N signals;

N coaxial transmission lines that transport the phase controlled signals; and a power combiner/divider adapted to receive the phase controlled signals from the coaxial transmission lines and output a combined signal, comprising:

a length of single-conductor closed waveguide terminated at one end by a conductive end plate, said end plate having a plurality N of holes;

a conductive matching plate, said matching plate positioned within the waveguide opposite to and spaced apart from the conductive end plate and spaced apart from inner walls of the waveguide; and a plurality N of dual-conductor coaxial input/output ports coupled to respective ones of the coaxial transmission lines, each port having an outer conductor that is electrically and mechanically terminated at said end plate about an associated said hole and an inner conductor that extends through the associated hole into the waveguide and is electrically and mechanically terminated at the underside of said matching plate, wherein the location and geometry of said conductive matching plate and the physical arrangement of the N input/output ports are configured so that at each one of the input/output ports the sum of a direct reflection of power and an N−1 coupled reflection of power are minimized.

18. The system of claim 17, wherein the phase controllers advance by 360/N degrees in a clockwise direction the phases of the plurality of N coherent signals as seen from the waveguide to generate a right-hand circularly-polarized output wave.

19. The system of claim 17, wherein the phase controllers advance by 360/N degrees in a counter-clockwise direction the phases of the plurality of N coherent signals as seen from the waveguide to generate a left-hand circularly-polarized output wave.

* * * * *